US011612908B2

(12) United States Patent
Schneider

(10) Patent No.: US 11,612,908 B2
(45) Date of Patent: Mar. 28, 2023

(54) NOZZLE HAVING QUADRILATERAL OUTLET FOR VISCOUS MATERIAL DISTRIBUTION

(71) Applicant: Albion Engineering Company, Morrestown, NJ (US)

(72) Inventor: Mark C. Schneider, Moorestown, NJ (US)

(73) Assignee: Albion Engineering Company, Moorestown, NJ (US)

( * ) Notice: Subject to any disclaimer, the term of this patent is extended or adjusted under 35 U.S.C. 154(b) by 353 days.

(21) Appl. No.: 16/984,705

(22) Filed: Aug. 4, 2020

(65) Prior Publication Data

US 2022/0040726 A1 Feb. 10, 2022

(51) Int. Cl.

| | |
|---|---|
| ***B05C 5/02*** | (2006.01) |
| ***B05C 17/005*** | (2006.01) |
| ***B43M 11/06*** | (2006.01) |
| ***B65D 35/38*** | (2006.01) |

(52) U.S. Cl.

CPC ..... *B05C 5/0254* (2013.01); *B05C 17/00503* (2013.01); *B43M 11/06* (2013.01); *B65D 35/38* (2013.01)

(58) Field of Classification Search

CPC . B05C 5/0254; B05C 17/00503; B65D 35/38; B43M 11/06

See application file for complete search history.

(56) References Cited

U.S. PATENT DOCUMENTS 6,722,536 B2 * 4/2004 Bremner ..... B65D 35/38 222/566
7,168,877 B2 * 1/2007 Park ..... B05C 17/0325 401/9
8,087,550 B2 1/2012 Schneider et al.

FOREIGN PATENT DOCUMENTS

JP 3200724 U * 10/2015

* cited by examiner

*Primary Examiner* — Jennifer C Chiang
(74) *Attorney, Agent, or Firm* — Design IP

(57) ABSTRACT

A dispensing nozzle for viscous material having a modified outlet is disclosed herein. The dispensing nozzle includes a first terminal portion, a second terminal portion, and a medial portion defined therebetween. The first terminal portion includes an attachment region configured to secure the dispensing nozzle to a dispensing gun. The second terminal portion includes a dispensing tip defining the outlet for the viscous material. The outlet has a quadrilateral profile in one embodiment. In another embodiment, the outlet has a square profile.

16 Claims, 8 Drawing Sheets

NOZZLE HAVING QUADRILATERAL OUTLET FOR VISCOUS MATERIAL DISTRIBUTION

FIELD OF INVENTION

The present disclosure relates to a nozzle for a viscous material dispensing device, and more particularly relates to a profile of the nozzle outlet.

BACKGROUND

Dispensing devices for the application of viscous materials, such as caulk, lubricant, adhesives, or sealants, are well known in the construction and home improvement industries. These dispensing devices, also known as dispensing guns, typically include a handle or trigger assembly which drives a piston or plunger relative to a viscous material cartridge in order to dispense the viscous material through a nozzle. The nozzle can be provided in various forms depending on the particular requirements of an application. One such configuration is disclosed in U.S. Pat. No. 8,087,550, which is commonly assigned to Albion Engineering Company, and is incorporated by reference as if fully set forth herein.

Known nozzle tips for viscous material dispensers typically include a circular outlet for the viscous material to be applied to a joint. FIG. 1A illustrates one such joint 1, as well as a backer rod 2 which is also typically used but is not required. The backer rod 2 fills the joint 1 and promotes better adhesion of the viscous material 3 to the work surfaces 4. Although circular dispensing outlets are common in the industry, these types of outlets result in an excessive amount of viscous material being deposited in the area defined between the backer rod and the work surfaces.

Once the viscous material is deposited, further tooling is required to remove excess viscous material, as illustrated in FIG. 1B. A scraping tool, such as a spatula 6, is typically used during the tooling process to remove the excess viscous material 3, which must then either be discarded or deposited back into a source container.

It would be desirable to provide a more efficient nozzle for a dispensing device that reduces the volume of excess viscous material applied to work surfaces.

SUMMARY

A dispensing nozzle for viscous material having a modified outlet is disclosed herein. The dispensing nozzle includes a first terminal portion, a second terminal portion, and a medial portion defined therebetween. The first terminal portion includes an attachment region configured to secure the dispensing nozzle to a dispensing gun. The second terminal portion includes a dispensing tip defining the outlet for the viscous material. The outlet has a quadrilateral profile. In one preferred embodiment, the outlet has a square profile.

In one embodiment, an outermost face of the dispensing tip is offset or angled 30 degrees to 45 degrees relative to a longitudinal axis (X) of the nozzle.

In one embodiment, an interior perimeter ($P_I$) defined by the outlet at the tip has a square profile when viewed along the longitudinal axis (X) of the dispensing nozzle.

Additional embodiments are disclosed herein.

BRIEF DESCRIPTION OF THE DRAWINGS

The foregoing Summary and the following Detailed Description will be better understood when read in conjunction with the appended drawings, which illustrate a preferred embodiment of the disclosure. In the drawings.

DETAILED DESCRIPTION OF THE PREFERRED EMBODIMENTS

Certain terminology is used in the following description for convenience only and is not limiting. "Axially" refers to a direction along an axis (X) of an assembly. "Radially" refers to a direction inward and outward from the axis (X) of the assembly. "Circumferentially" refers to a direction extending along a curve or circumference of a respective element relative to the axis (X) of the assembly.

A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
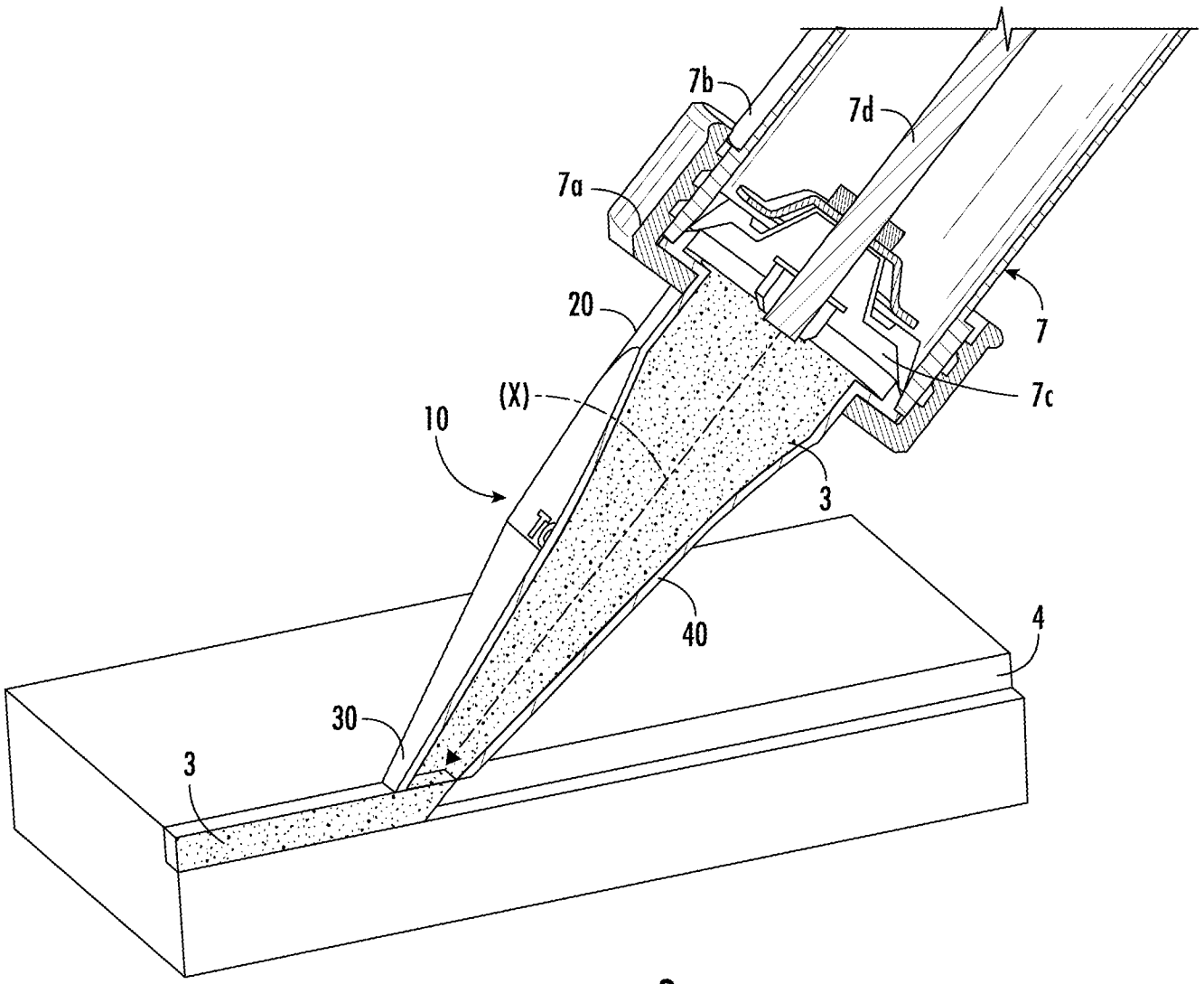
FIG. 2 is a perspective cross-sectional view of a dispensing device including a dispensing nozzle according to the invention.

As shown in FIG. 2, a dispensing nozzle 10 for a dispensing gun 7 configured to dispense viscous material 3 is disclosed herein. The dispensing gun 7 generally includes a front cap 7*a*, a barrel 7*b*, a piston assembly 7*c*, and a rod 7*d*. The rod 7*d* generally drives the piston assembly 7*c* such that viscous material 3 inside of the barrel 7*b* is distributed via the nozzle 10. In one embodiment, the viscous material 3 is a self-leveling compound or caulk. One of ordinary skill in the art would understand based on this disclosure that other viscous materials can be used with this dispensing nozzle 10.

In one embodiment, the dispensing nozzle 10 is formed from a thermoplastic polymer. One of ordinary skill in the art would understand based on this disclosure that various materials and methods could be used to form the nozzle 10.

The dispensing nozzle 10 includes a first terminal portion 20, a second terminal portion 30, and medial portion 40 defined therebetween. The first terminal portion 20 includes an attachment region 22 configured to secure the dispensing nozzle 10 to the dispensing gun 7. The attachment region 22 includes an enlarged collar which is dimensioned to be received within an opening of the dispensing gun 7 and to engage the front cap 7*a*.

The second terminal portion 30 includes a dispensing tip 32 that defines an outlet 34 for dispensing the viscous material 3. The outlet 34 generally has a quadrilateral profile. More specifically, the outlet 34 can have a parallelogram profile.

Figure 4A:
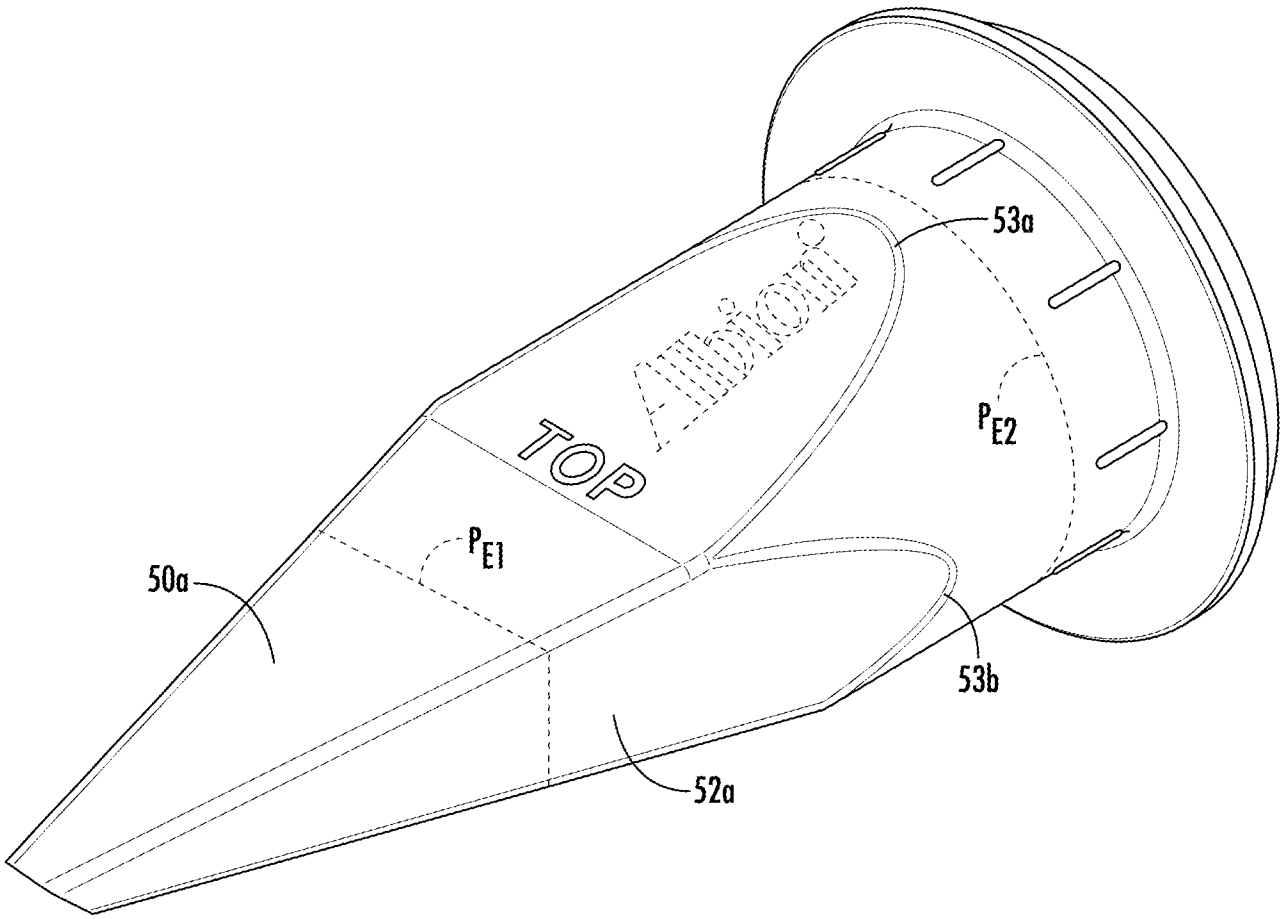
FIG. 4A is top perspective view of the dispensing nozzle of FIGS. 3A and 3B.
Figure 4B:
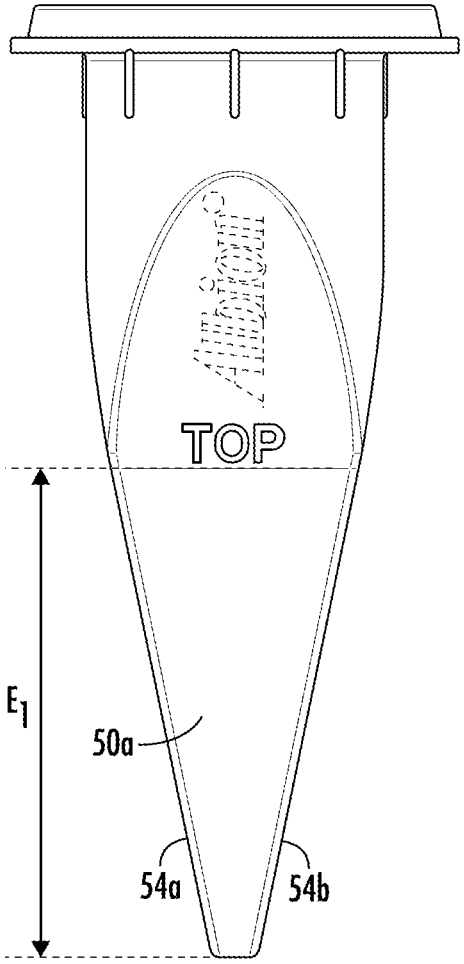
FIG. 4B is a top planar view of the dispensing nozzle of FIGS. 3A, 3B, and 4A.
Figure 4C:
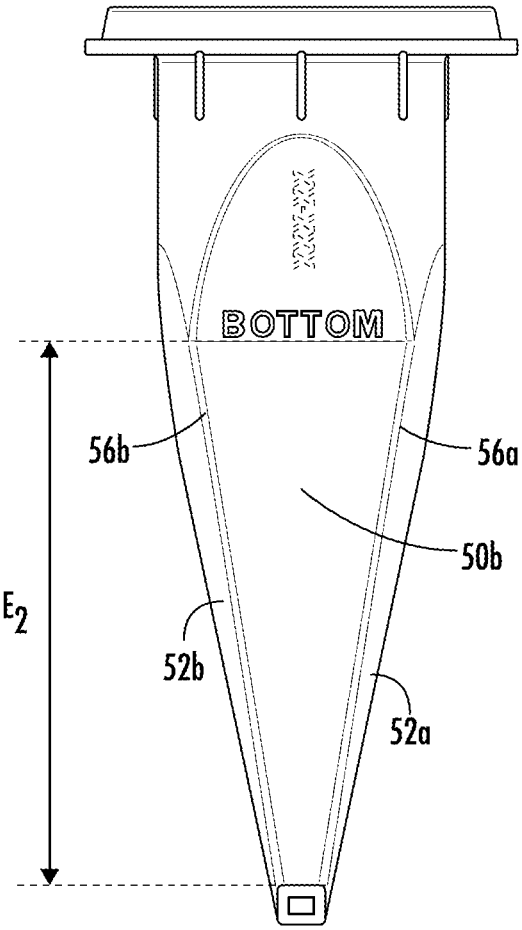
FIG. 4C is a bottom planar view of the dispensing nozzle of FIGS. 3A, 3B, 4A, and 4B.
Figure 4D:
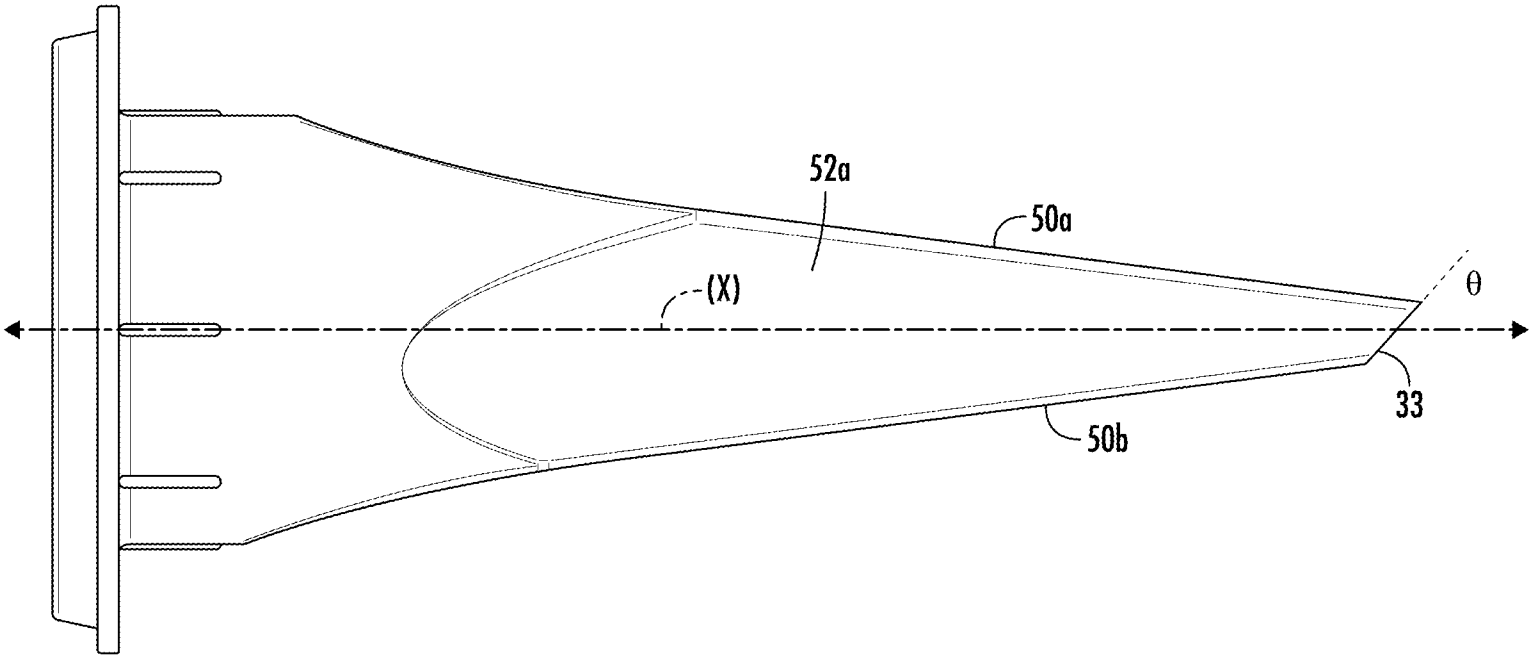
FIG. 4D is a side view of the dispensing nozzle of FIGS. 3A, 3B, and 4A-4C.
Figure 4E:
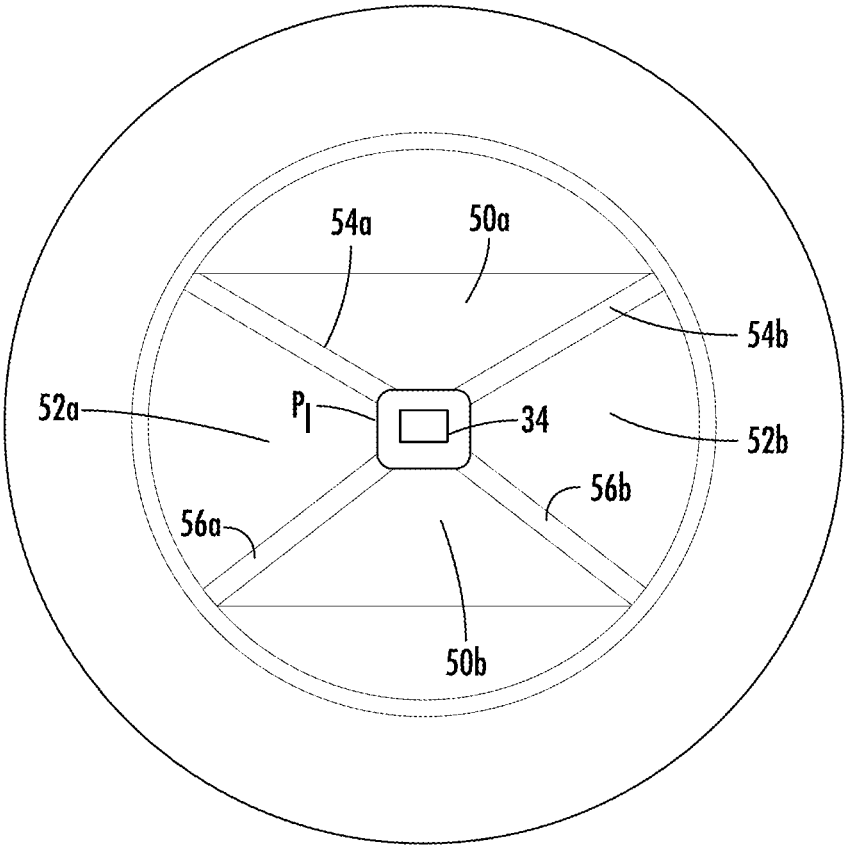
FIG. 4E is a rear planar view of the dispensing nozzle of FIGS. 3A, 3B, and 4A-4D.

In one embodiment, the outlet 34 has a square profile when viewed along the longitudinal axis (X), as shown most clearly in FIG. 4E. In another embodiment, the outlet 34 has a rectangular profile. One of ordinary skill in the art would understand based on this disclosure that alternative shapes, including polygons having more than four sides can be used.

As shown in FIGS. 2 and 4D, the longitudinal axis (X) of the dispensing nozzle 10 extends between the first terminal portion 20 and the second terminal portion 30. An outermost face 33 of the tip 32 is offset or angled 30 degrees to 45 degrees relative to the longitudinal axis (X), as shown by angle (θ). One of ordinary skill in the art would understand based on this disclosure that the angle of the tip 32 can be altered to meet the specific requirements of different joint configurations.

Due to the medial portion 40 having a tapered profile, users of the nozzle 10 can cut the nozzle 10 at any section along the medial portion 40 to alter the dimensions of the outlet 34. Any subsequent modifying cuts to the nozzle 10 should be performed at 30 degrees to 45 degrees to ensure a generally square profile of the outlet 34. Indicators can be provided on the outer surface of the nozzle 10 to provide visual cues regarding how and where to cut the nozzle 10.

As shown in FIG. 4E, an interior perimeter ($P_I$) defined inside of the outlet 34 at the tip 32 has a square profile (when viewed along the longitudinal axis (X)). While the interior perimeter ($P_I$) has a square profile, a first exterior perimeter ($P_{E1}$) (shown in FIG. 4A) defined by the dispensing nozzle 10 at both the medial portion 40 and the second terminal portion 30 has a rectangular profile. The differing profiles between the interior perimeter ($P_I$) and the first exterior perimeter ($P_{E1}$) are due to the angled tip 32 of the nozzle 10, and various geometrical features of the nozzle 10 described in more detail herein.

As shown in FIG. 4A, the first exterior perimeter ($P_{E1}$) transitions to a second exterior perimeter ($P_{E2}$) having a circular profile at the first terminal portion 20 (i.e. the attachment end). This transition is primarily due to the generally circular shape of the attachment end of the dispensing gun 7 and tubular profile of most viscous material cartridges and chambers. One of ordinary skill in the art would understand that the shape of the first terminal portion 20 can vary.

The medial portion 40 and the second terminal portion 30 are defined by a first pair of walls 50*a*, 50*b* (i.e. the top and bottom walls), and a second pair of walls 52*a*, 52*b* (i.e. the side walls) The term "walls" as used in this context refers to a planar surface, and therefore includes regions of the second terminal portion 30 and the medial portion 40 up until the rounded area of the first terminal portion 20. The first pair of walls 50*a*, 50*b* each have a greater length along the longitudinal axis (X) than the second pair of walls 52*a*, 52*b*.

Based on the geometry of the walls 50*a*, 50*b*, 52*a*, 52*b*, if the nozzle 10 were to be cut perpendicular to the longitudinal axis (X), then the outlet 34 would have a rectangular profile matching the exterior of the nozzle 10. However, by forming the nozzle 10 with an angled outermost face 33 at the tip 32, the resulting outlet 34 has a square profile. This geometrical relationship is also valid for any subsequent cutting of the nozzle 10 at the predetermined angle (θ).

As shown in FIG. 4E, a first pair of edges 54*a*, 54*b* is defined at intersections of the top wall 50*a* and the right wall 52*a* and the left wall 52*b*. The first pair of edges 54*a*, 54*b* each have a first extent ($E_1$), as shown in FIG. 4B. Likewise, a second pair of edges 56*a*, 56*b* is defined at intersections of the bottom wall 50*b* with the right wall 52*a*, and the left wall 52*b*. As shown in FIG. 4C, the second pair of edges 56*a*, 56*b* each have a second extent ($E_2$), which is greater than the first extent ($E_1$).

Figure 3A:
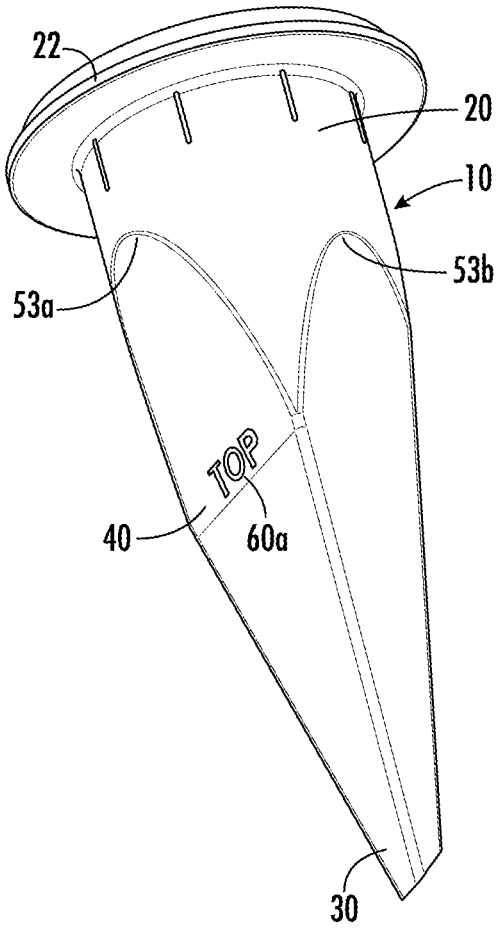
FIGS. 3A and 3B are side perspective views of the dispensing nozzle of FIG. 2.
Figure 3B:
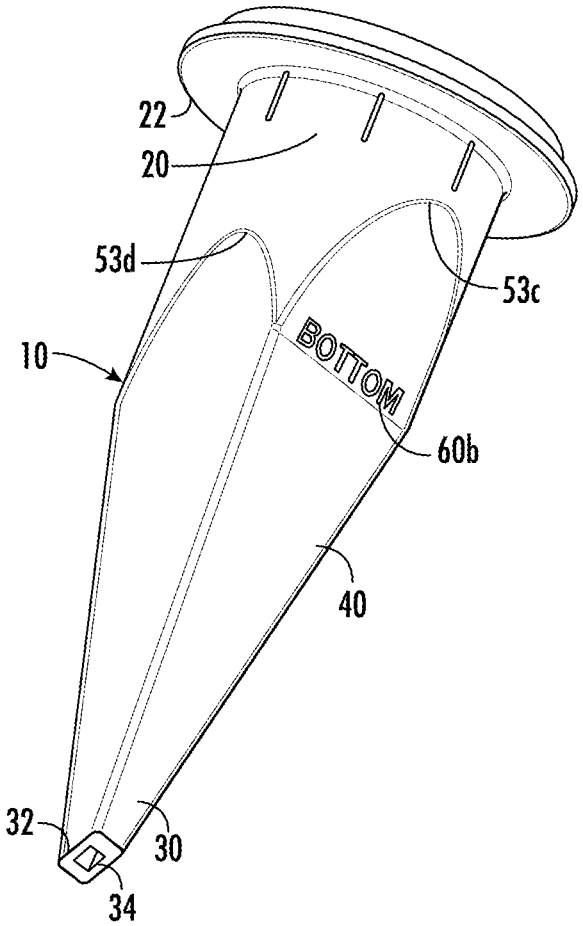

As shown in FIGS. 3A, 3B, and 4A, longitudinal end 53*a*, 53*b*, 53*c*, 53*d* of the top wall 50*a*, the bottom wall 50*b*, the right wall 52*a*, and the left wall 52*b* that are adjacent to the first terminal portion 20 each have a curved edge. One of ordinary skill in the art would understand that the profiles of the longitudinal ends 53*a*, 53*b*, 53*c*, 53*d* can vary.

In one embodiment, an indicator 60*a*, 60*b* is provided on the dispensing nozzle 10 to designate a preferred orientation for using the dispensing nozzle 10. In one embodiment, markings can be provided to illustrate how to cut the nozzle 10 to provide varying sizes of the outlet 34 while maintaining a square outlet profile.

Figure 1A:
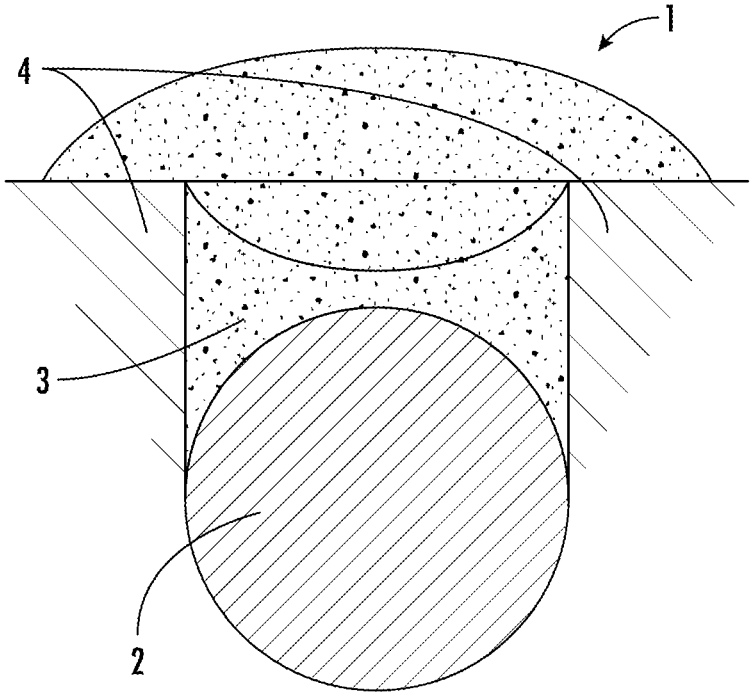
FIG. 1A PRIOR ART
FIG. 1A is a cross-sectional view illustrating the application of viscous material to work surfaces using a nozzle according to the prior art.
Figure 1B:
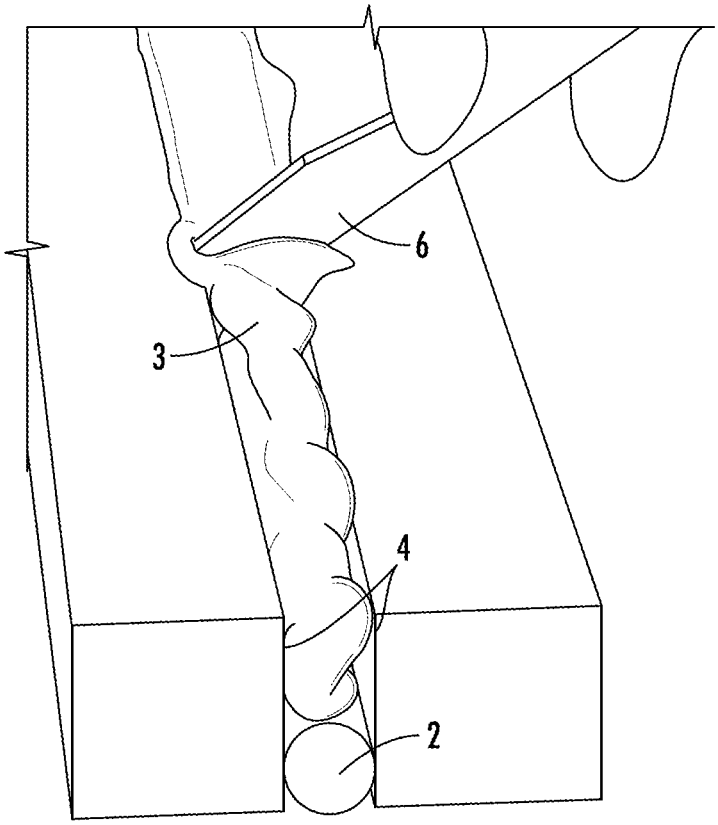
FIG. 1B PRIOR ART
FIG. 1B is a perspective view illustrating further tooling required after application of the viscous material in FIG. 1A.

A method of dispensing viscous material to a joint is also disclosed. The method includes: (1) providing a dispensing nozzle including the features disclosed herein, and (2) dispensing viscous material to a joint via the dispensing nozzle, such that tooling of the joint is not required to remove excess viscous material. This method contrasts with the arrangement and method disclosed by FIG. 1B, which requires tooling, i.e. scraping with spatula 6, to remove excess viscous material.

Having thus described the present disclosure in detail, it is to be appreciated and will be apparent to those skilled in the art that many physical changes, only a few of which are exemplified in the detailed description of the invention, could be made without altering the inventive concepts and principles embodied therein.

It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the embodiments being indicated by the appended claims rather than by the foregoing description, and all alternate embodiments and changes to this embodiment which come within the meaning and range of equivalency of said claims are therefore to be embraced therein.

What is claimed is:

1. A dispensing nozzle for a viscous material, the dispensing nozzle comprising:

a first terminal portion, a second terminal portion, and a medial portion defined therebetween, the first terminal portion including an attachment region configured to secure the dispensing nozzle to a dispensing gun;

the second terminal portion including a dispensing tip defining an outlet for the viscous material, the outlet having a quadrilateral profile; and, wherein the medial portion and the second terminal portion are each defined by a first pair of walls and a second pair of walls, and wherein each wall of the first pair of walls and the second pair of walls is planar along its length and tapers uniformly as it extends from the medial portion to the dispensing tip.

2. The dispensing nozzle of claim 1, wherein a longitudinal axis (X) of the dispensing nozzle extends between the first terminal portion and the second terminal portion, and an outermost face of the tip is angled 30 degrees to 45 degrees relative to the longitudinal axis (X).

3. The dispensing nozzle of claim 2, wherein an interior perimeter ($P_I$) defined by the outlet at the tip has a square profile when viewed along the longitudinal axis (X) of the dispensing nozzle.

4. The dispensing nozzle of claim 3, wherein a first exterior perimeter ($P_{E1}$) defined by the dispensing nozzle at both the medial portion and the second terminal portion has a rectangular profile.

5. The dispensing nozzle of claim 4, wherein the first exterior perimeter ($P_{E1}$) transitions to a second exterior perimeter ($P_{E2}$) at the first terminal portion, and the second exterior perimeter ($P_{E2}$) has a circular profile.

6. The dispensing nozzle of claim 1, wherein each wall of the first pair of walls is longer than each wall of the second pair of walls.

7. The dispensing nozzle of claim 6, wherein the first pair of walls includes a top wall and a bottom wall, and the second pair of walls includes a right wall and a left wall, a first pair of edges defined at intersections of the top wall and the right wall and the left wall has a first extent ($E_1$), and a second pair of edges defined at intersections of the bottom wall with the right wall and the left wall has a second extent ($E_2$), and the second extent ($E_2$) is greater than the first extent ($E_1$).

8. The dispensing nozzle of claim 7, wherein longitudinal ends of the top wall, the bottom wall, the right wall, and the left wall each have a curved edge.

9. The dispensing nozzle of claim 1, wherein the viscous material is a self-leveling compound or caulk.

10. The dispensing nozzle of claim 1, wherein the dispensing nozzle is formed from a thermoplastic polymer.

11. The dispensing nozzle of claim 1, wherein an indicator is provided on the dispensing nozzle to designate a preferred orientation for using the dispensing nozzle.

12. The dispensing nozzle of claim 1, wherein the dispensing nozzle has a uniform thickness.

13. The dispensing nozzle of claim 1, wherein a top wall and a bottom wall of the nozzle have an identical width at any predetermined cross-section along the medial portion, and a right wall and a left wall have an identical width at any predetermined cross-section along the medial portion.

14. The dispensing nozzle of claim 1, wherein the dispensing nozzle is configured to attach to a viscous material dispensing gun having a circular barrel.

15. The dispensing nozzle of claim 1, wherein the outlet is configured to maintain the quadrilateral profile after cutting the dispensing nozzle on a bias.

16. A method for dispensing viscous material to a joint, the method comprising:

providing a dispensing nozzle including:

a first terminal portion, a second terminal portion, and a medial portion defined therebetween, the first terminal portion including an attachment region configured to secure the dispensing nozzle to a dispensing gun, and the second terminal portion including a dispensing tip defining an outlet for the viscous material, the outlet having a quadrilateral profile; and dispensing viscous material to a joint via the dispensing nozzle, wherein tooling of the joint is not required to remove excess viscous material.

* * * * *